United States Patent [19]

Bergmaier

[11] 3,967,435

[45] July 6, 1976

[54] COIN-STACKING AND COUNTING DEVICE

[76] Inventor: Gerard J. Bergmaier, 1238 Union Ave., Delair, N.J. 08110

[22] Filed: Sept. 13, 1974

[21] Appl. No.: 505,842

[52] U.S. Cl. ..... 53/254
[51] Int. Cl.[2] ..... B65B 67/02
[58] Field of Search ..... 53/254; 133/1 A, 8 A

[56] References Cited

UNITED STATES PATENTS

| | | | |
|---|---|---|---|
| 1,084,569 | 1/1914 | Batdorf | 53/254 X |
| 1,274,615 | 8/1918 | Sherwood | 53/254 X |
| 1,457,261 | 5/1923 | Mathewes | 53/254 |

FOREIGN PATENTS OR APPLICATIONS

| | | | |
|---|---|---|---|
| 553,110 | 1/1933 | Germany | 53/254 |

*Primary Examiner*—Travis S. McGehee
*Attorney, Agent, or Firm*—Synnestvedt & Lechner

[57] ABSTRACT

A coin-stacking and counting device, for use with an open-ended coin wrapper, which can be used to manually prepare a stack of a predetermined number of coins.

1 Claim, 3 Drawing Figures

Fig. 2.
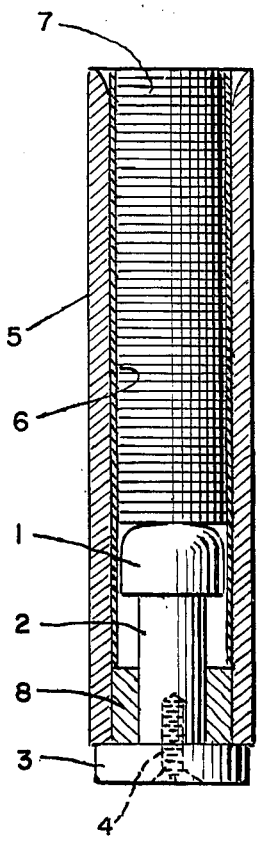
Fig. 3.
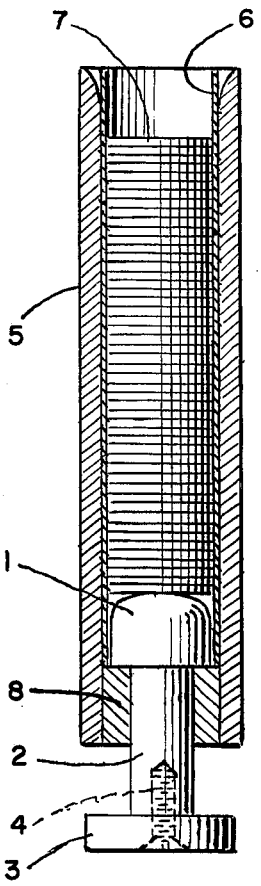
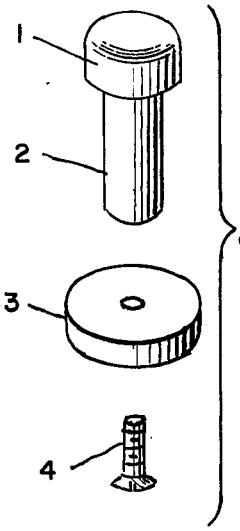
Fig. 1.

COIN-STACKING AND COUNTING DEVICE

FIELD OF THE INVENTION

The invention relates to the preparation and wrapping of a stack of a predetermined number of coins or other objects of similar geometrical configuration.

Banks, stores, and other users of large numbers of coins commonly handle them in wrapped rolls containing a known number of coins. The rolls are more easily handled and stored than individual coins in bulk. There is less likelihood of misplacing or spilling of coins when utilizing wrapped rolls thereof. The rolls permit easier and more exact counting of large numbers of coins.

The present invention allows one simply and rapidly to prepare a stack of a predetermined number of coins and to wrap them securely. The device of the present invention can be used with available, inexpensive cylindrical paper wrappers, which can be stored flat when not in use.

REPORTED DEVELOPMENTS

Manual coin-stacking and counting devices are disclosed in German Pat. No. 553,110 to Eden and the following U.S. Pat. Nos. 1,084,569 to Batdorf; 1,274,615 to Sherwood; 2,678,525 to Sheldon; and 3,206,914 to Norris.

Each of the devices disclosed in the aforementioned patents has one or more of the following disadvantages: the absence of provisions for ascertaining when a particular desired number of coins has been stacked; unsuitability for use with wrappers of differing lengths for a given number of coins to be stacked; incapability of standing by itself upright on a flat surface during the coin-stacking operation; necessity for two or more separate pieces in carrying out the operation; possibility of providing at a stack end an insufficient amount of wrapper for folding over and sealing that end; and possibility of the slippage of the wrapper along side of the coin stack when folding the wrapper over the upper end of the coin stack.

An object of the present invention is the provision of an improved device for stacking, counting and wrapping coins.

SUMMARY OF THE INVENTION

The present invention provides a device for stacking in an open-ended coin wrapper a predetermined number of coins, or similarly-shaped objects, and has dimensions such that a sufficient amount of wrapper extends beyond each end of the stack for folding over so that the coins can be sealed in the wrapper. The device comprises a coin-holding tube into which said wrapper is inserted and a coin-supporting head which is movable between a coin-stacking position and a wrapper-sealing position. In said coin-stacking position, the top surface of the coin-supporting head is elevated above the bottom surface of the coin-holding tube a distance which provides a sufficient amount of wrapper for folding over and sealing each stack end and such that the distance from said top surface to the edge of the coin-holding tube is equal to the height of a stack of the desired number of coins. In said wrapper-sealing position, the top surface of said coin-supporting head is elevated above the bottom of the coin-holding tube a distance such that a sufficient amount of wrapper is present to fold over one end of the coin stack. The coin-supporting head is shaped so that the first coin or coins inserted into the tube tend to assume a horizontal position. The device also includes base means external of the coin-holding tube and movable with the coin-supportng head for supporting the device in an upright position when the coin-supporting head is in said stacking position.

BRIEF DESCRIPTION OF THE DRAWINGS

FIG. 1 is an exploded view showing the coin-supporting head of the device of the present invention and the base to which it is attached.

FIG. 2 is a sectional view showing the coin-supporting head in the coin-stacking position.

FIG. 3 is a sectional view showing the coin-supporting head in the wrapper-sealing position.

DETAILED DESCRIPTION OF THE INVENTION

With reference to FIGS. 2 and 3, the device shown therein includes an open-ended tube 5 provided with a sleeve 8 at its bottom end having an opening for receiving the movable rod 2. Integral with the rod 2 is a coin-supporting head 1 having a substantially flat top surface which supports the coin stack 7 in a horizontal position and a rounded edge which is effective in positioning the first coin or the first few coins which are inserted into the tube in a horizontal position. The bottom end of the rod 2 is provided with a threaded opening for receiving the screw 4 which attaches the base 3 to the rod 2. The base 3 is shaped to support the tube 5 in an upright position. FIGS. 2 and 3 show a wrapper 6 within the tube 5 and a stack of coins 7 within the wrapper.

As to the relative dimensions of the device, and with reference to FIG. 2, which shows the device in the coin-stacking position, the distance from the top of the coin-supporting head 1 to the top of the tube 5 is equal to the height of a stack of the predetermined number of coins that it is desired to count and wrap. For example, said distance can be equal to the height of a stack of 50 pennies or 40 nickles or 50 dimes or 20 quarters, quantities of coins generally wrapped in commercially available wrappers. Thus, when using the device it is not necessary to count the coins because the predetermined desired number will be present in the wrapper 6 when the coin stack is level with the top of the tube 5. FIGS. 2 and 3 represent 50 pennies in the stack 7.

The diameter of the tube 5 is somewhat larger than the coins being stacked, being large enough to also accommodate the wrapper 6. The wrapper 6 should fit snugly around the coins and the tube 5 should fit snugly around the wrapper 6.

The length of the coin-holding tube is long enough to accommodate the desired number of coins plus at least a length of wrapper for folding over one end of the coin stack. In the coin-stacking position shown in FIG. 2, the coin-supporting head 1 extends into the tube 5 a distance from the bottom of the tube such that the length of wrapper 7 between the top surface of the coin-supporting head 1 and the bottom of the wrapper, that is, the end supported on the sleeve 8, is equal to about twice the length of wrapper 6 needed to fold over one end of the coin stack 7. Preferably the length of wrapper for folding over one end of the coin stack is somewhat larger than the radius of the coins being wrapped. This permits the end of the stack to be completely sealed by the wrapper. Thus, in FIG. 2 the distance between the top surface of the coin-supporting head 1 and the bottom of the tube 5 is represented to be somewhat larger than the diameter of a penny. Said length can be longer. If said length is shorter and the wrapper is not long enough to extend beyond the top of the tube 5, tape or other sealing means can be used to seal the ends of the wrapper.

In using the device in the coin-stacking position, one coin or a few coins are inserted initially into the tube 5 containing the wrapper 6. The convex shaped coin-supporting head 1 helps to position the first or first few coins inserted substantially simultaneously on the head in a horizontal position even if the coins are dropped into the tube in a vertical or angular position. Additional coins are inserted until the height of the stack is level or even with the top of the tube 5 at which point the desired number of coins will be present in the wrapper.

Thereafter the coin-supporting head 1 is moved to the wrapper-sealing position as shown in FIG. 3. This is accomplished by lifting the tube 5 upwardly which results in the coin-supporting head 1 moving to the bottom of the tube 5, and the coin stack 7 moving to below the top of the tube as shown in FIG. 3. The coin-supporting head, as a result of its length, positions the bottom of the coin stack 7 above the bottom of the tube a distance equal to the length of wrapper needed to fold over the bottom end of the coin stack, preferably a length somewhat larger than the radius of the coin. A similar length of wrapper is available at the top end of the coin stack 7. Holding the device in one hand, the fingers of the other hand can be used to fold over the wrapper and seal the top end of the coin stack. This done, the device is inverted, the one-ended wrapped coin stack slides out of the tube and the other end of the stack is sealed by folding over the end portion of the wrapper. Thus, the desired number of coins is wrapped and sealed.

Various modifications may be made to the device illustrated. For example, one or more additional rod sections adapted to be attached to rod 2 can be used in counting and wrapping a different number of coins in the same coin-holding tube. The base instead of being flat can comprise legs which support the tube in an upright position. Other modifications can also be made while preserving the functional characteristics of the device.

The device of the present invention can be made of any suitable material such as metal or plastic. The wrapper will generally comprise paper, but it can be made of other suitable material. The device can be used to count and wrap coins or other thin circular or non-circular flat objects, the term "coin" being used to include within its meaning such objects.

I claim:

1. A coin-stacking and counting device for use with an open-ended coin wrapper having a length greater than the height of a stack of a predetermined number of coins to be wrapped to provide at each end of the wrapper an end portion capable of being folded over to enclose the end of said stack comprising:

1. a coin-holding tube circular in cross section and of diameter slightly greater than the diameter of said coins and having an open coin-receiving end for receiving said coins and the length of said tube being slightly greater than the sum of (1) the height of said stack of predetermined number of coins and (2) said diameter;

2. a coin-supporting head contained within said tube at the other end thereof and movable within said tube into a coin-stacking position and a wrapper-sealing position, said head extending into said tube in said coin-stacking position a distance such that the distance from the top of said head to the top of the coin-receiving end of said tube equals the height of said stack of said predetermined number of coins, said head having a length substantially equal to the radius of said tube so that the distance from the top of said head to said other end, in said wrapper-sealing position, is substantially equal to the radius of said tube; said head having a convex shape to hold said coins in a horizontal position and to position angularly inserted coins in said horizontal position;

3. a sleeve at said other end of said tube having a diameter equal to the inside diameter of said tube and having an opening therein, the diameter of which is less than said inside diameter;

4. base means external of said tube for supporting said device in an upright position when said head is in said coin-stacking position; and

5. a movable rod positioned within said opening having one end connected to said base means and the other end connected to the bottom of said head.

* * * * *